US011072841B2

(12) United States Patent
Yang et al.

(10) Patent No.: US 11,072,841 B2
(45) Date of Patent: Jul. 27, 2021

(54) HIGH-STRENGTH DUAL-SCALE STRUCTURE TITANIUM ALLOY, PREPARATION METHOD THEREFOR, AND APPLICATION THEREOF

(71) Applicant: SOUTH CHINA UNIVERSITY OF TECHNOLOGY, Guangzhou (CN)

(72) Inventors: Chao Yang, Guangzhou (CN); Yaguang Yao, Guangzhou (CN); Shengguan Qu, Guangzhou (CN); Xiaoqiang Li, Guangzhou (CN); Weiwen Zhang, Guangzhou (CN); Yuanyuan Li, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 529 days.

(21) Appl. No.: 15/580,057

(22) PCT Filed: Dec. 20, 2016

(86) PCT No.: PCT/CN2016/111020
§ 371 (c)(1),
(2) Date: Dec. 6, 2017

(87) PCT Pub. No.: WO2017/076369
PCT Pub. Date: May 11, 2017

(65) Prior Publication Data

US 2018/0298469 A1 Oct. 18, 2018

(30) Foreign Application Priority Data

Nov. 3, 2015 (CN) ..... 201510742842.9

(51) Int. Cl.
*C22C 14/00* (2006.01)
*C22C 1/04* (2006.01)
*B22F 9/04* (2006.01)

(52) U.S. Cl.
CPC ..... *C22C 14/00* (2013.01); *C22C 1/04* (2013.01); *C22C 1/0458* (2013.01); *B22F 2009/043* (2013.01); *B22F 2998/10* (2013.01)

(58) Field of Classification Search
None
See application file for complete search history.

(56) References Cited

U.S. PATENT DOCUMENTS 10,344,356 B2 * 7/2019 Yang ..... B22F 3/16
2006/0048603 A1 * 3/2006 Sundin ..... C22C 29/04 75/238

(Continued)

FOREIGN PATENT DOCUMENTS

CN 1665949 9/2005
CN 101492781 7/2009

(Continued)

OTHER PUBLICATIONS

Yang et al., "First-principles Calculation Assisted Thermodynamic Modeling of Ti—Co—Cu Ternary System," Journal of Materials Science & Technology, vol. 26, Issue 4, (2010), p. 317-326, https://doi.org/10.1016/S1005-0302(10)60052-7 (Year: 2010).*

(Continued)

*Primary Examiner* — Coris Fung
*Assistant Examiner* — Christopher D. Moody
(74) *Attorney, Agent, or Firm* — JMB Davis Ben-David

(57) ABSTRACT

A high-strength dual-scale structure titanium alloy, a preparation method therefor, and an application thereof, belonging to the technical field of alloy processing. The composition system of the titanium alloy is Ti—Nb—Cu—Co—Al, the atomic percentage of the various elements being 58~70% Ti, 9~16% Nb, 4~9% Cu, 4~9% Co, and 2~8% Al. The microstructure comprises a dual-scale coexistence of micro-crystal isometric bcc β-Ti and ultra-fine crystal iso- (Continued)

metric bcc β-Ti, and a dual-scale coexistence of micro-crystal strip fcc $CoTi_2$ and ultra-fine crystal isometric fcc $CoTi_2$, or an ultra-fine crystal strip fcc $CoTi_2$ twin crystal is distributed along a boundary of a dual-scale substrate, the dual-scale substrate being a nano needle-shaped martensite a' phase dispersed within micro-crystal bcc β-Ti. The mechanical properties of the titanium alloy are significantly improved, and the titanium alloy may be used in fields such as aerospace and aviation, weaponry and sports equipment.

7 Claims, 2 Drawing Sheets

(56) References Cited

U.S. PATENT DOCUMENTS

| | | | | |
|---|---|---|---|---|
| 2006/0213592 | A1 | 9/2006 | Ko et al. | |
| 2009/0042057 | A1* | 2/2009 | Thomas | A01K 95/005 428/665 |
| 2017/0137917 | A1* | 5/2017 | Yang | B22F 3/14 |

FOREIGN PATENT DOCUMENTS

| | | | | |
|---|---|---|---|---|
| CN | 103305722 | | 9/2013 | |
| CN | 104232995 | | 12/2014 | |
| CN | 104674038 | A * | 6/2015 | C22C 14/00 |
| CN | 105296802 | | 2/2016 | |
| JP | S599145 | | 1/1984 | |
| WO | WO-2016127716 | A1 * | 8/2016 | B22F 3/14 |

OTHER PUBLICATIONS

Liu et al., "Ultrafine grained Ti-based composites with ultrahigh strength and ductility achieved by equiaxing microstructure," Materials & Design, vol. 79, (2015), p. 1-5, https://doi.org/10.1016/j.matdes.2015.04.032 (Year: 2015).*

Espacenet machine translation of CN 104232995 (Year: 2019).*

Liu et al., "A new insight into high-strength Ti62Nb12.2Fe13.6Co6.4Al5.8 alloys with bimodal microstructure fabricated by semi-solid sintering" (2016), Scientific Reports, 6:23467, DOI: 10.1038/srep23467 (Year: 2016).*

Li. Y.Y. et al. "Nucleation and Growth Mechanism of Crystalline Phase for Fabrication of Ultratind-Grained Ti66Nb13Cu8Ni6.8A16.2 Composites by Spark Plasma Sintering and Crystallization of Amorphous Phase", Materials Science and Engineering A, vol. 528, No. 1, 25 Nov. 2010, pp. 486-493.

Yin et al "Mechanical behavior of microstructure engineered," multi-length-scale titanium over a wide range of strain rates Acta Materialia, (2013), http://dx.doi.org/10.1016/j.actamat.2013.03.011.

Wen et al "Strengthening mechanisms in a high-strength bulk nanostructured Cu—Zn—Al alloy processed via cryomilling and spark plasma sintering" Acta Materialia 61 (2013) 2769-2782.

Dao et al "Toward a quantitative understanding of mechanical behavior of nanocrystalline metals" Acta Materialia 55 (2007) 4041-4065.

Ovid'ko et al "Review on superior strength and enhanced ductility of metallic nanomaterials" Progress in Materials Science 94 (2018) 462-540.

Zhilyaev and Langdon "Using high-pressure torsion for metal processing: Fundamentals and applications" Progress in Materials Science 53 (2008) 893-979.

* cited by examiner

HIGH-STRENGTH DUAL-SCALE STRUCTURE TITANIUM ALLOY, PREPARATION METHOD THEREFOR, AND APPLICATION THEREOF

CROSS-REFERENCE TO RELATED APPLICATIONS

This is the U.S. National Stage of International Application No. PCT/CN2016/111020 filed Dec. 20, 2016, which was published in Chinese under PCT Article 21(2), which in turn claims the benefit of China Patent Application No. 201510742842.9, filed Nov. 3, 2015.

FIELD OF THE INVENTION

The invention relates to the technical field of the alloy materials, and in particular to a high-strength bimodal structure titanium alloy, a preparation method and an application thereof.

BACKGROUND OF THE INVENTION

As an important structural metal developed from the 1950s, titanium alloy has been widely used in the chemical industry, automobile, healthcare, aerospace and other fields because of its low density, high strength, high heat-resistance and good corrosion resistance. As titanium alloy is an important engineering structural material, the achievement of a titanium alloy with a higher strength and toughness to meet the application in more demanding conditions has become the eternal goal of scientific researchers. Effectively improving the preparation process of titanium alloy, and accurately regulating the microstructure (phase types, scale, morphology and distribution) of titanium alloy have been regarded as the most two effective ways to improve the strength and toughness of titanium alloy by the majority of researchers.

At present, He et al. reported a method to obtain a high-strength dual-scale titanium alloy by changing the microstructure in Nature. They obtained a series of bimodal structure titanium alloy with a fcc nano-crystalline matrix+micrometer-crystalline ductile bcc β-Ti dendrites by the copper mold casting. The formation mechanism of this bimodal structure is as follows: during the melt alloy cooling process from the high melting temperature, a part of the liquid phase in the semi-solid temperature range preferentially solidifies and precipitates as a bcc β-Ti phase with a high melting point, bcc β-Ti grows into micrometer dendrite crystals after a sufficient holding time, and the remaining liquid phase forms a fcc nano-crystalline matrix during subsequent rapid cooling and solidification process. In the deformation process, the fcc nano-crystalline matrix in the formed bimodal structure titanium alloy provides a super high strength for the material, while the ductile micrometer bcc β-Ti dendrites contributes a high plasticity of the material with a fracture strength greater than 2000 MPa and a fracture strain greater than 10%. Then, more and more high-strength bimodal titanium alloy systems with such a system structure of a nano-crystalline matrix+micrometer dendrites have been reported continuously. However, there also are two defects in this method: firstly, since the five element compositions easily form intermetallic compounds offsetting the enhancement effects of the dendriting and deteriorating the ductility of materials, this method to prepare the bimodal structure has a narrow selection range of compositions; secondly, the copper mold casting has an extremely high requirement of a cooling rate, as a result the size of these high-strength bimodal structure titanium alloy prepared is generally a few millimeters. The above two factors have become major bottlenecks limiting the practical application of these high-strength bimodal structure titanium alloy.

As an alternative to the forming technology, the powder metallurgy can be used to prepare materials with characteristics of a uniform composition, a high material utilization rate and near net shaping, it is easy to prepare a high-strength alloy with ultrafine crystals/nanometer crystals and commonly used in the preparation of the alloy components with a large size and a complex shape. In recent years, with the intersection and integration of disciplines, a series of semi-solid processing technologies of powder consolidation processing combining extrusion, forging and rolling and etc, have come into being. However, up to now, the semi-solid processing technology has mainly focused on the alloy systems with a low melting point such as an aluminum alloy and a magnesium alloy. Since the preparation produces of semi-solid slurry or blank required in the semi-solid processing is relatively complex, it is difficult to prepare the semi-solid metal alloy with a high melting point, which greatly limits the potential developments of the semi-solid processing technology and restricts the application range of the alloy systems of related technology. In addition, the sizes of microstructure crystals of the alloy prepared by the existing semi-solid processing process are very coarse (usually tens of microns or more), it is difficult to obtain the crystalline refined microstructure such as ultrafine crystals or nano-crystals, and it is impossible to prepare the bimodal or multi-scale structure.

In view of this, on the basis of the titanium alloy systems used in the above copper mold casting method, the research group proposes a series of high strength titanium alloy (the strength greater than 2500 MPa and the fracture strain greater than 30%) by a powder consolidation and amorphous crystalline method based on amorphous crystallization theory. The mechanism of this preparation method is: firstly preparing an amorphous/nano-crystalline composite powder by an mechanical alloying method, then solidifying and forming the amorphous/nano-crystalline composite powder by a powder consolidation method, preferentially precipitating the bcc β-Ti from the amorphous/nano-crystalline composite powder during the heating process, then precipitating a fcc second phase, finally forming the equiaxed ultrafine crystalline β-Ti matrix+second equiaxed ultrafine crystalline fcc phase composite structure. The method is not limited by the cooling rate, and it can be used to prepare an alloy with a large-size block and also having more excellent mechanical properties. It is to be noted that the dual-scare structure of a fcc nano-crystalline matrix+micrometer crystalline β-Ti dendrites prepared above by the copper mold casting method has to be kept in a temperature for a period of time in a semi-solid temperature range (that is, a solid-liquid coexistence interval), then be rapidly cooled to obtain a two-scale structure. Also a large number of studies have shown that the melting point of bcc β-Ti with a high melting point is usually higher than 1943 K and the melting point of fcc phase with a low melting point is usually lower than 1500 K, that is, in the two temperature ranges, the alloy is in a wide half-solidation temperature range. However, in the above-mentioned powder consolidation+amorphous crystallization method to prepare the above equiaxed ultrafine crystalline β-Ti matrix+equiaxed ultrafine fcc second phase composite structure, the sintering temperature is always smaller than the alloy melting temperature; at the same time, since the growths of two phases of bcc β-Ti and fcc are both solid-solid transformation, the thermodynamic growth conditions thereof are basically the same, bimodal structure cannot be prepared.

In conclusion, if the above amorphous/nano-crystalline powder having two phases of bcc β-Ti and fcc crystals were melted at a melting temperature higher than the melting point of fcc phase with a low melting point and lower than bcc β-Ti temperature with a high melting point; that is, if they were sintered in the semi-solid temperature range of the alloy, by reasonably regulating the sintering temperature, sintering pressure, holding time, cooling rate and other process parameters of the semi-solid sintering process, a new high-strength bimodal structure would finally be prepared, which differs from the dual-scare structure of nano-crystalline matrix+micrometer dendrites prepared by copper mold casting, at the same time differs from the equiaxed ultrafine crystalline composite structure by the powder consolidation+amorphous crystallization method. This has an important theoretical and engineering significance to develop a new high-performance new-structure titanium alloy material and net near forming engineering components to meet the industrial applications.

CONTENTS OF THE INVENTION

Based on the above prior art, a first object of the present invention is to provide a high-strength bimodal structure titanium alloy.

Another object of the present invention is to provide a preparation method for the above high-strength bimodal structure titanium alloy.

A further object of the present invention is to provide an application of the above high-strength bimodal structure titanium alloy.

The object of the present invention is achieved by the following technical solution.

A high-strength bimodal structure titanium alloy, wherein the composition system of the titanium alloy is Ti-MR-Ma-Mb-Mc, wherein MR is an element Nb, Ta, Mo or V stabilized in the β-Ti phase and improving the melting point of β-Ti; Ma-Mb is elements Cr—Co, Cu—Co, Cu—Ni, Fe—Co, Fe—In, Fe—V, Fe—Ga, Fe—Sn or FeGa which are solid dissolved with each other; Mc is an element Al, Sn, Ga, In, Bi or Sb stabilized in the α-Ti phase; the microstructure comprises two-phase structures with both coexistence and distribution of two scales, that is, the bimodal coexistence of the micrometer crystalline equiaxed bcc β-Ti and the ultrafine crystalline equiaxed bcc β-Ti, as well as the bimodal coexistence of the micrometer crystalline fcc $MbTi_2$ and the ultrafine crystalline equiaxed fcc $MbTi_2$; or the microstructure comprises the ultrafine crystalline fcc $MbTi_2$ twin distributed along the boundary of the bimodal matrix, and the bimodal matrix is the micrometer crystalline bcc β-Ti with dispersive distribution of a nanometer acicular martensite α' phase.

Preferably, the high-strength bimodal structure titanium alloy according to claim 1, characterized in that the composition system of the titanium alloy is Ti—Nb—Cu—Co—Al, the percentages of the various atom elements are Ti 58~70 at. %, Nb 9~16 at. %, Cu 4~9 at. %, Co 4~9 at. %, Al 2~8 at. %, and unavoidable micro-impurities; the microstructure comprises two-phase structures with both coexistence and distribution of two scales, that is, the bimodal coexistence of the micrometer crystalline equiaxed bcc β-Ti and the ultrafine crystalline equiaxed bcc β-Ti, as well as the bimodal coexistence of the micrometer crystalline strip fcc $CoTi_2$ and the ultrafine crystalline equiaxed fcc $CoTi_2$; or the microstructure comprises the ultrafine crystalline fcc $CoTi_2$ twin distributed along the boundary of the bimodal matrix, and the bimodal matrix is the micrometer crystalline bcc β-Ti with dispersive distribution of a nanometer acicular martensite α' phase.

The preparation method for said high-strength bimodal structure titanium alloy, characterized in that the method comprising the following steps:

(1) mixing powder: designing the ingredients of alloy according to the principle of two crystalline phases fcc of $CoTi_2$ and bcc β-Ti having different melting points, formulating the elemental powder according to the percentage, then uniformly mixing same;

(2) preparing the alloy powder by high energy ball milling: placing the uniformly mixed powder in an inert-atmosphere protected ball mill for high-energy ball milling, until forming the alloy powder with a nano-crystalline or amorphous structure, conducting thermal analyses of the ball milling alloy powders, confirming the characteristic temperature of the melting peak of fcc phase with a low melting point and the characteristic temperature of bcc β-Ti with a high melting point in the alloy powder during the heating process, including the starting melting temperature, the peak melting temperature and the ending melting temperature;

(3) semisolid sintering alloy powder: placing the alloy powder in step (2) into a mold for sintering, the sintering process comprise three stages: ① increasing the temperature to a temperature lower than the starting melting temperature of the fcc phase with a low melting point under the sintering pressure, and conducting a densification sintering process of the alloy powder; ② sequentially increasing the temperature to semisolid sintering temperature $T_s$, where the starting melting temperature of the melting peak of the fcc phase with a low melting point≤$T_s$≤the temperature of the melting peak of bcc β-Ti with a high melting point, and conducting semi-solid sintering process under the sintering pressure of 10~500 MPa for 10 min~2 h; ③ keep the pressure and cooling to room temperature to obtain a high-strength bimodal structure titanium alloy.

Preferably, the particle size of said elemental powder in step (1) is 20~100 μm.

Preferably, said high-energy ball milling in step (2) refers to the ball milling with a speed of 2~6 r/s for 1~100 h, and the ratio of ball material is 7:1~12:1.

Preferably, said mold in step (3) is a graphite mold, and sintering pressure is 10~100 MPa.

Preferably, said mold in step (3) is a tungsten mold, and sintering pressure is 60~500 MPa.

Preferably, said cooling to the room temperature in step (3) refers to direct cooling with the furnace or cooling with a adjusted cooling rate of 10~250° C./min.

The use of said high-strength bimodal structure titanium alloy in the aerospace, weapons, or sports equipment (Such as a high-strength alloy material with a larger size, a complex shape, or suitable for engineering applications, and nearly net forming parts thereof, such as gears, thin-wall tube, armor, golf head and etc.).

The preparation method and the product obtained therefrom have the following advantages and good technical effects:

(1) In the present invention, the microstructure of the material is regulated by the combined technology of the powder metallurgy and the semi-solid processing. The microstructure comprises two phase structures with bimodal coexistence distribution, that is, the bimodal coexistence of the micrometer crystalline equiaxed bcc β-Ti and the ultrafine crystalline equiaxed bcc β-Ti, as well as the bimodal coexistence of the micrometer crystalline strip fcc $CoTi_2$ and the ultrafine crystalline equiaxed fcc $CoTi_2$; or the microstructure comprises the ultrafine crystalline fcc $CoTi_2$ twin distributed along the boundary of the bimodal matrix, and the bimodal matrix is the micrometer crystalline bcc β-Ti with a dispersive distribution of nanometer acicular martensite α' phase; in order to obtain a new high-strength dual-scare structure titanium alloy. The compressive strength and plasticity of the optimum alloy reach up to 3139 MPa and 42.3% respectively, the comprehensive mechanical properties of the alloy are much higher than those of the bimodal titanium alloy with the nano-crystalline matrix+ductile micrometer β-Ti dendrite crystalline structure by copper mold casting.

(2) The semi-solid sintering preparation process in present invention is the interdisciplinary subject of the powder metallurgy and the semi-solid processing, which overcomes the defect that the traditional semi-solid processing technology only producing coarse crystalline structure, and extends the traditional powder metallurgical solid-solid forming to the new semi-solid powder metallurgical sintering process with solid-liquid coexistence. The multi-scale coexistence structures of nano-crystals/ultrafine-crystals and micrometer-crystals can be prepared by a variety of alloy systems with a high melting point such as a titanium alloy, so that the preparation method of the invention broadens the application range of alloys for semi-solid processing process.

(3) The solid-liquid coexistent semi-solid alloy obtained in the present invention has the advantages of a small viscosity, being easy rheology and easy forming, so that it can be used for preparing parts with a complex shape by near net shaping such as gears, thin-walled tubes, armors and golf ball heads. The obtained high-strength bimodal structure titanium alloy is larger in size, the finally obtained components do not need processing or only requires a small amount of processing, the molds can be reasonably designed to form the complex components directly; as a result the present invention provides a new method for forming the net shape shaping components.

(4) The forming method of present invention combined the powder metallurgy and the semi-solid sintering technology has the advantages of simple and practical molds, convenient operations, a high product yield, saved raw materials and the near net shaping; at the same time, the size of the formed alloy material can be regulated by molds, the internal interface is clean and its crystal sizes are controllable.

DESCRIPTION OF EXAMPLE EMBODIMENTS OF THE INVENTION

Figure 1:
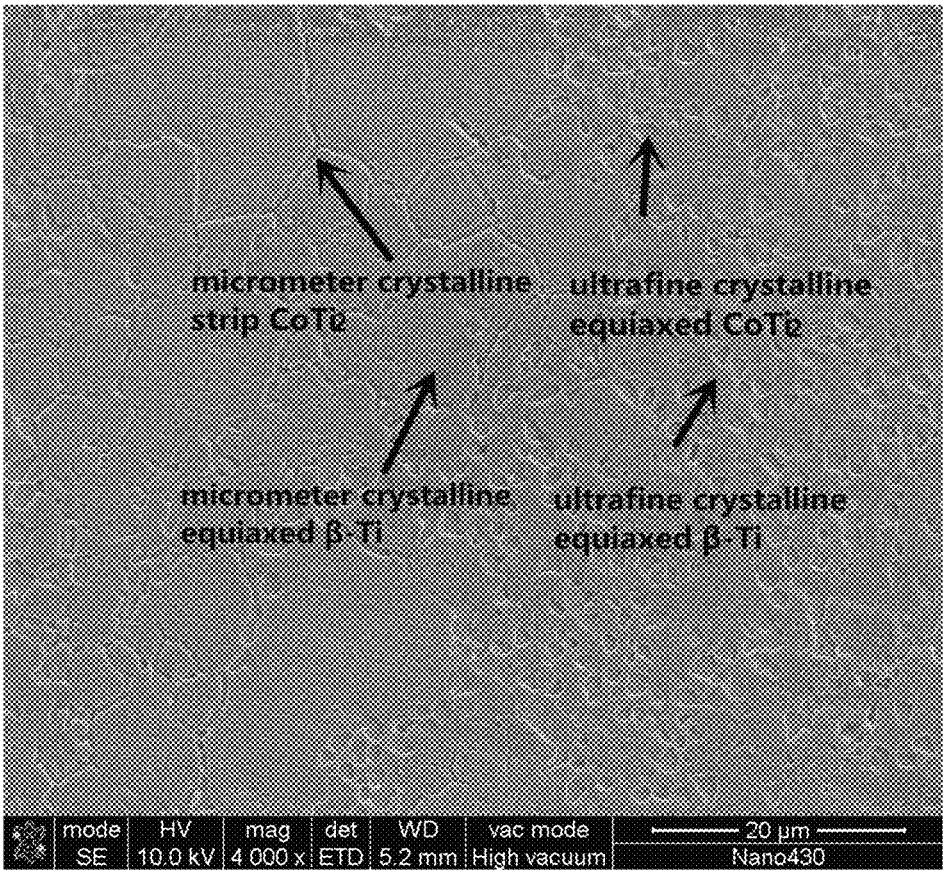
FIG. 1 is a scanning electron microscope image of the structure of the high-strength bimodal structure titanium alloy prepared in example 1.

The present invention will be further described in detail below with reference to examples and figures; however, the embodiments of the present invention are not limited thereto.

Example 1

(1) Mixing powder: according to the principle of two crystalline phases fcc of $CoTi_2$ and bcc β-Ti having distinctly different melting points, choosing $Ti_{68.8}Nb_{13.6}Cu_{5.1}Co_6Al_{6.5}$ (atom percentage) as the alloy compositions, formulating the powder ingredients in the mass ratio of the selected alloy system; selecting particles with a size of 75 μm in this example to prepare an element powder by an atomization method, then uniformly mixing the elemental powder in the powder mixer.

(2) Preparing the alloy powder by high energy ball milling:

placing uniformly mixed powder in the argon-protected planetary ball mill (QM-2SP20) for high-energy ball milling, wherein the tank body, the grinding-ball materials and other milling mediums are all made of stainless steel, the diameters of the grinding balls are 15, 10 and 6 mm respectively, and the weight ratio is 1:3:1. The process parameters of the high-energy ball milling are as follows: introducing high purity argon (99.999%, 0.5 MPa) into the ball milling talk, the ratio of ball to materials is 7:1, the speed is 3 r/s, taking out 3 g powder form the argon-protected glove box to carry out X-ray Diffraction and differential scanning calorimetry (DSC) tests every 10 h. After 90 h of milling time, the results of X-ray diffraction and transmission electron microscopy analyses show that the powder structures after 90 h milling are an amorphous phase/β-Ti nano-crystalline composite powder, the results of DSC analysis shows that the melting temperature of the melting peak of fcc $CoTi_2$ phase in the powder after 90 h ball milling is 1138° C., and the melting point of bcc β-Ti is usually higher than 1670° C. (1943K) and cannot be reflected by the DSC curve since the test temperature of the DSC equipment can only reach up to 1300° C. Nevertheless, it still can be confirmed that the alloy enters the semi-solid zone when the sintering temperature is between 1138° C. and 1670° C.

(3) Semisolid sintering alloy powder: taking 20 g of the prepared alloy powder, placing it into a graphite sintering mold with a diameter of Φ20 mm, wrapping the powder with tantalum paper to prevent the reaction with impurities, firstly pre-pressing the alloy powder to 50 MPa by the positive and negative graphite electrode, pumping vacuum to $10^{-2}$ Pa, and then introducing high purity argon gas for protection; and fast sintering by a pulsed current, the process conditions are as follows:

sintering equipment: Dr. Sintering SPS-825 spark plasma sintering system sintering processing: pulsed current duty ratio of the pulsed current: 12:2 sintering temperature $T_s$: 1150° C.

sintering pressure: 30 MPa sintering time: increasing the temperature to 1100° C. for 11 minutes under the 30 MPa pressure, then increasing the temperature to 1150° C. for 1 minutes, keeping the temperature for 5 minutes, followed by cooling it to room temperature with the furnace.

Obtaining a high-strength bimodal structure titanium alloy material by sintering with a diameter of Φ20 mm (the larger the size of the mold, the greater the size of the prepared alloy materials), and a density of 5.5 g/cm$^3$.

A high-strength bimodal structure titanium alloy is obtained in this example. The bimodal structure is the coexistence of the ultrafine crystalline equiaxed bcc β-Ti and the micrometer crystalline equiaxed β-Ti, as well as the coexistence of the ultrafine crystalline equiaxed fcc $CoTi_2$ and the micrometer crystalline strip $CoTi_2$, which is different from the dual-scare structure reported of titanium alloy in current reports. The compressive stress and strain tests show that the compressive fracture strength and fracture strain of the high-strength bimodal structure titanium alloy are 2486 MPa and 37% respectively.

Example 2

(1) Mixing powder: According to the principle of two crystalline phases of fcc $CoTi_2$ and bcc β-Ti having distinctly different melting points, choosing $Ti_{68.8}Nb_{13.6}Cu_{5.1}Co_6Al_{6.5}$ (atom percentage) as the alloy compositions, formulating the powder ingredients in the mass ratio of the selected alloy system; particles with a size of 75 μm in this example are selected to prepare an element powder by an atomization method, then uniformly mixing the elemental powder in the powder mixer.

(2) Preparing the alloy powder by high energy ball milling:

placing uniformly mixed powder in the argon-protected planetary ball mill (QM-2SP20) for high-energy ball milling, wherein the tank body, the grinding-ball materials and other milling mediums are all made of stainless steel, the diameters of the grinding balls are 15, 10 and 6 mm respectively, and the weight ratio is 1:3:1. The process parameters of the high-energy ball milling are as follows: introducing high purity argon (99.999%, 0.5 MPa) into the ball milling talk, the ratio of ball to materials is 7:1, the speed is 3 r/s, taking out 3 g powder form the argon-protected glove box to carry out X-ray Diffraction and differential scanning calorimetry (DSC) tests every 10 h. After 90 h of milling time, the results of X-ray diffraction and transmission electron microscopy analyses show that the powder structures after 90 h milling are an amorphous phase/β-Ti nano-crystalline composite powder, the results of DSC analysis shows that the melting temperature of the melting peak of fcc $CoTi_2$ phase in the powder after 90 h ball milling is 1138° C.

(3) Semisolid sintering alloy powder:

taking 20 g of the prepared alloy powder, placing it into a graphite sintering mold with a diameter of Φ20 mm, wrapping the powder with tantalum paper to prevent the reaction with impurities, firstly pre-pressing the alloy powder to 50 MPa by the positive and negative graphite electrode, pumping vacuum to $10^{-2}$ Pa, and then introducing high purity argon gas for protection; and fast sintering by a pulsed current, the process conditions are as follows:

sintering equipment: Dr. Sintering SPS-825 spark plasma sintering system sintering processing: pulsed current duty ratio of the pulsed current: 12:2 sintering temperature $T_s$: 1250° C.

sintering pressure: 30 MPa sintering time: increasing the temperature to 1200° C. for 12 minutes under the 30 MPa pressure, then increasing the temperature to 1250° C. for 1 minutes, keeping the temperature for 5 minutes, followed by cooling it to room temperature with the furnace.

Obtaining a high-strength bimodal structure titanium alloy material by sintering with a diameter of Φ20 mm (the larger the size of the mold, the greater the size of the prepared alloy materials), and a density of 5.6 g/cm$^3$.

Figure 2:
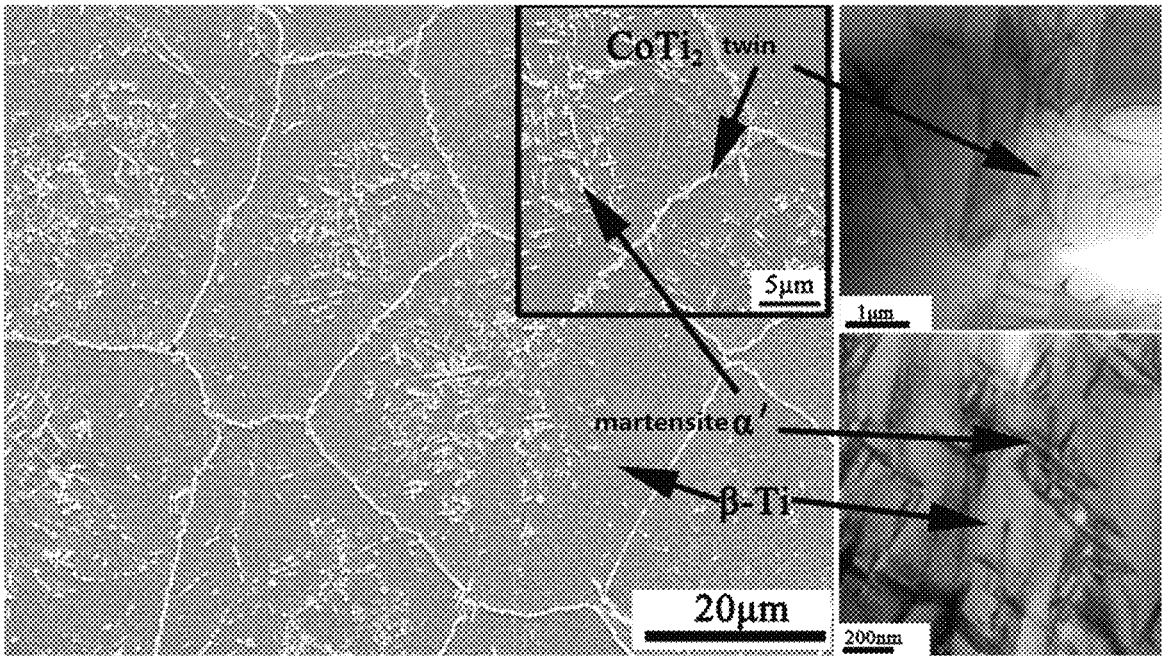
FIG. 2 is a scanning electron microscope image and a transmission electron microscope image of the structure of the high-strength bimodal structure titanium alloy prepared in example 2.
Figure 3:
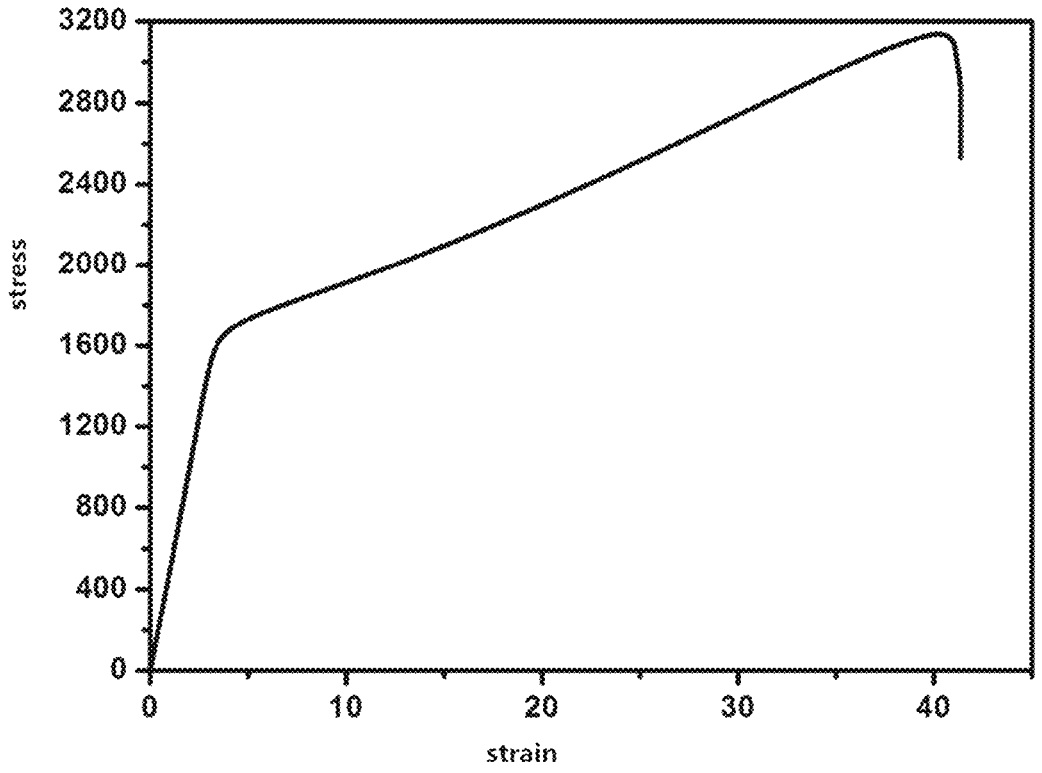
FIG. 3 is a stress-strain curve of the structure of the high-strength bimodal structure titanium alloy prepared in example 1.

It is shown as FIG. 2 that the scanning electron microscope image (left) and transmission electron microscope image (right) of a high-strength bimodal structure titanium alloy obtained in this example. It can be seen from FIG. 2 that the microstructure comprises the ultrafine crystalline fcc $CoTi_2$ twin distributed along the boundary of the bimodal matrix. The bimodal matrix is the micrometer crystalline bcc β-Ti with dispersive distribution of nanometer acicular martensite α', which is different from the dual-scare structure of titanium alloy in current reports. As shown in FIG. 3, the compressive fracture strength and fracture strain are 3139 MPa and 42.3% respectively, which is superior to the mechanical properties of titanium alloys in current reports.

Example 3

(1) Mixing powder: According to the principle of two crystalline phases of fcc $CoTi_2$ and bcc β-Ti having distinctly different melting points, choosing $Ti_{58}Nb_{16}Cu_9Co_9Al_8$ (atom percentage) as the alloy compositions, formulating the powder ingredients in the mass ratio of the selected alloy system; particles with a size of 70 μm in this example are selected to prepare an element powder by an atomization method, then uniformly mixing the elemental powder in the powder mixer.

(2) Preparing the alloy powder by high energy ball milling:

placing uniformly mixed powder in the argon-protected planetary ball mill (QM-2SP20) for high-energy ball milling, wherein the tank body, the grinding-ball materials and other milling mediums are all made of stainless steel, the diameters of the grinding balls are 15, 10 and 6 mm respectively, and the weight ratio is 1:3:1. The process parameters of the high-energy ball milling are as follows: introducing high purity argon (99.999%, 0.5 MPa) into the ball milling talk, the ratio of ball to materials is 7:1, the speed is 6 r/s, taking out 3 g powder form the argon-protected glove box to carry out X-ray Diffraction and differential scanning calorimetry (DSC) tests every 10 h. After 100 h of milling time, the results of X-ray diffraction and transmission electron microscopy analyses show that the powder structures after 100 h milling are an amorphous phase/β-Ti nano-crystalline composite powder, the results of DSC analysis shows that the melting temperature of the melting peak of fcc $CoTi_2$ phase in the powder after 100 h ball milling is 1156° C.

(3) Semisolid sintering alloy powder:

taking 20 g of the prepared alloy powder, placing it into a graphite sintering mold with a diameter of Φ20 mm, wrapping the powder with tantalum paper to prevent the reaction with impurities, firstly pre-pressing the alloy powder to 50 MPa by the positive and negative graphite electrode, pumping vacuum to $10^{-2}$ Pa, and then introducing high purity argon gas for protection; and fast sintering by a pulsed current, the process conditions are as follows:

sintering equipment: Dr. Sintering SPS-825 spark plasma sintering system sintering processing: pulsed current duty ratio of the pulsed current: 12:2 sintering temperature $T_s$: 1200° C.

sintering pressure: 100 MPa sintering time: increasing the temperature to 1100° C. for 11 minutes under the 100 MPa pressure, then increasing the temperature to 1200° C. for 1 minutes, keeping the temperature for 5 minutes, followed by cooling it to room temperature with the furnace.

Obtaining a high-strength bimodal structure titanium alloy material by sintering with a diameter of Φ20 mm (the larger the size of the mold, the greater the size of the prepared alloy materials), and a density of 5.6 g/cm$^3$.

A high-strength bimodal structure titanium alloy is obtained in this example. The bimodal structure is the coexistence of the ultrafine crystalline equiaxed bcc β-Ti and the micrometer crystalline equiaxed β-Ti, as well as the coexistence of the ultrafine crystalline equiaxed fcc $CoTi_2$ and the micrometer crystalline strip $CoTi_2$ which is different from the dual-scare structure of titanium alloy in current reports. The compressive stress and strain tests show that the compressive fracture strength and fracture strain of the high-strength bimodal structure titanium alloy are 2687 MPa and 36% respectively.

Example 4

(1) Mixing powder: According to the principle of two crystalline phases of fcc $CoTi_2$ and bcc β-Ti having distinctly different melting points, choosing $Ti_{70}Nb_{16}Cu_{7.2}Co_{4.8}Al_2$ (atom percentage) as the alloy compositions, formulating the powder ingredients in the mass ratio of the selected alloy system; particles with a size of 75 μm in this example are selected to prepare an element powder by an atomization method, then uniformly mixing the elemental powder in the powder mixer.

(2) Preparing the alloy powder by high energy ball milling:

placing uniformly mixed powder in the argon-protected planetary ball mill (QM-2SP20) for high-energy ball milling, wherein the tank body, the grinding-ball materials and other milling mediums are all made of stainless steel, the diameters of the grinding balls are 15, 10 and 6 mm respectively, and the weight ratio is 1:3:1. The process parameters of the high-energy ball milling are as follows: introducing high purity argon (99.999%, 0.5 MPa) into the ball milling talk, the ratio of ball to materials is 7:1, the speed is 6 r/s, taking out 3 g powder form the argon-protected glove box to carry out X-ray Diffraction and differential scanning calorimetry (DSC) tests every 10 h. After 80 h of milling time, the results of X-ray diffraction and transmission electron microscopy analyses show that the powder structures after 80 h milling are an amorphous phase/β-Ti nano-crystalline composite powder, the results of DSC analysis shows that the melting temperature of the melting peak of fcc $CoTi_2$ phase in the powder after 100 h ball milling is 1168° C.

(3) Semisolid sintering alloy powder:

taking 20 g of the prepared alloy powder, placing it into a graphite sintering mold with a diameter of Φ20 mm, wrapping the powder with tantalum paper to prevent the reaction with impurities, firstly pre-pressing the alloy powder to 50 MPa by the positive and negative graphite electrode, pumping vacuum to $10^{-2}$ Pa, and then introducing high purity argon gas for protection; and fast sintering by a pulsed current, the process conditions are as follows:

sintering equipment: Dr. Sintering SPS-825 spark plasma sintering system sintering processing: pulsed current duty ratio of the pulsed current: 12:2 sintering temperature $T_s$: 1300° C.

sintering pressure: 50 MPa sintering time: increasing the temperature to 1200° C. for 12 minutes under the 50 MPa pressure, then increasing the temperature to 1300° C. for 2 minutes, keeping the temperature for 5 minutes, followed by cooling it to room temperature with the furnace.

Obtaining a high-strength bimodal structure titanium alloy material by sintering with a diameter of Φ20 mm (the larger the size of the mold, the greater the size of the prepared alloy materials), and a density of 5.5 g/cm$^3$.

The microstructure of the high-strength bimodal structure titanium alloy obtained in this example comprises the ultrafine crystalline fcc $CoTi_2$ twin distributed along the boundary of the bimodal matrix. The bimodal matrix is the micrometer crystalline bcc β-Ti with dispersive distribution of nanometer acicular martensite α', which is different from the dual-scare structure of titanium alloy in current reports. It can be seen from the compressive stress-strain curve of the titanium alloy obtained in this example that the compressive fracture strength and fracture strain are 2969 MPa and 40.3% respectively, which is superior to the mechanical properties of titanium alloys in current reports.

Example 5

(1) Mixing powder: According to the principle of two crystalline phases of fcc $CoTi_2$ and bcc β-Ti having distinctly different melting points, choosing $Ti_{70}Nb_{9.4}Cu_7Co_{6.8}Al_{6.8}$ (atom percentage) as the alloy compositions, formulating the powder ingredients in the mass ratio of the selected alloy system; particles with a size of 70 am in this example are selected to prepare an element powder by an atomization method, then uniformly mixing the elemental powder in the powder mixer.

(2) Preparing the alloy powder by high energy ball milling:

placing uniformly mixed powder in the argon-protected planetary ball mill (QM-2SP20) for high-energy ball milling, wherein the tank body, the grinding-ball materials and other milling mediums are all made of stainless steel, the diameters of the grinding balls are 15, 10 and 6 mm respectively, and the weight ratio is 1:3:1. The process parameters of the high-energy ball milling are as follows: introducing high purity argon (99.999%, 0.5 MPa) into the ball milling talk, the ratio of ball to materials is 7:1, the speed is 6 r/s, taking out 3 g powder form the argon-protected glove box to carry out X-ray Diffraction and differential scanning calorimetry (DSC) tests every 10 h. After 90 h of milling time, the results of X-ray diffraction and transmission electron microscopy analyses show that the powder structures after 90 h milling are an amorphous phase/β-Ti nano-crystalline composite powder, the results of DSC analysis shows that the melting temperature of the melting peak of fcc $CoTi_2$ phase in the powder after 100 h ball milling is 1175° C.

(3) Semisolid sintering alloy powder:

taking 20 g of the prepared alloy powder, placing it into a graphite sintering mold with a diameter of Φ20 mm, wrapping the powder with tantalum paper to prevent the reaction with impurities, firstly pre-pressing the alloy powder to 50 MPa by the positive and negative graphite electrode, pumping vacuum to $10^{-2}$ Pa, and then introducing high purity argon gas for protection; and fast sintering by a pulsed current, the process conditions are as follows:

sintering equipment: Dr. Sintering SPS-825 spark plasma sintering system sintering processing: pulsed current duty ratio of the pulsed current: 12:2 sintering temperature $T_s$: 1350° C.

sintering pressure: 30 MPa sintering time: increasing the temperature to 1300° C. for 13 minutes under the 30 MPa pressure, then increasing the temperature to 1350° C. for 1 minutes, keeping the temperature for 5 minutes, followed by cooling it to room temperature with the furnace.

Obtaining a high-strength bimodal structure titanium alloy material by sintering with a diameter of Φ20 mm (the larger the size of the mold, the greater the size of the prepared alloy materials), and a density of 5.5 g/cm$^3$.

The microstructure of the high-strength bimodal structure titanium alloy obtained in this example comprises the ultrafine crystalline fcc $CoTi_2$ twin distributed along the boundary of the bimodal matrix. The bimodal matrix is the micrometer crystalline bcc β-Ti with dispersive distribution of nanometer acicular martensite α', which is different from the dual-scare structure of titanium alloy in current reports. It can be seen from the compressive stress-strain curve of the titanium alloy obtained in this example that the compressive fracture strength and fracture strain are 3028 MPa and 39.8% respectively, which is superior to the mechanical properties of titanium alloys in current reports.

The invention claimed is:

1. A preparation method for a high-strength dual-scale titanium alloy, the high-strength dual-scale titanium alloy comprising Ti, MR, Ma, Mb and Mc;

wherein MR is one of Nb, Ta, Mo and V, wherein the MR is stable in β-Ti phase and increases the melting point of β-Ti; Ma-Mb is one of Cr—Co, Cu—Co, Cu—Ni, Fe—Co, Fe—In, Fe—V, Fe—Ga, Fe—Sn or Fe—Ga, Ma and Mb being solutionized in each other; Mc is one of Al, Sn, Ga, In, Bi or Sb stable in α-Ti phase; the high-strength dual-scale titanium alloy comprises two dual-scale phases including a first phase composed of micro-crystalline equiaxed bcc β-Ti and ultrafine crystalline equiaxed bcc β-Ti, and a second phase composed of micro-crystalline fcc $MbTi_2$ and ultrafine crystalline equiaxed fcc $MbTi_2$; or the high-strength dual-scale titanium alloy comprises a dual-scale substrate and ultrafine crystalline fcc $MbTi_2$ twin crystals distributed along the boundary of the dual-scale substrate, and the dual-scale substrate comprises micro-crystalline bcc β-Ti with nano-scale acicular martensite α' phase distributed inside;

wherein the preparation method comprises:

(1) providing predetermined amounts of metal powders according to a composition of the high-strength dual-scale titanium alloy, such that fcc and bcc crystalline phases with different melting points are formed in a subsequent sintering process in step (3), and uniformly mixing the metal powders;

(2) placing the uniformly mixed metal powders in an inert-atmosphere protected ball mill for high-energy ball milling to form nano-crystalline or amorphous alloy powders; conducting a thermal analysis on the nano-crystalline or amorphous alloy powders, so as to obtain characteristic temperatures of the melting peaks of the fcc phase with a lower melting point and the bcc β-Ti phase with a higher melting point in the nano-crystalline or amorphous alloy powders, the characteristic temperatures including initial melting temperature, peak melting temperature and ending melting temperature;

(3) placing the nano-crystalline or amorphous alloy powders in step (2) into a mold for sintering, the sintering process comprising: ① increasing the temperature to a temperature lower than the initial melting temperature of the fcc phase with a lower melting point under a first sintering pressure, and sintering the nano-crystalline or amorphous alloy powders for densification; ② further increasing the temperature to a semisolid sintering temperature $T_s$, where the initial melting temperature of the melting peak of the fcc phase with a lower melting point $T_s \leq$the initial melting temperature of the melting peak of the bcc β-Ti phase with a higher melting point, and conducting a semi-solid sintering process under a second sintering pressure of 10-500 MPa for 10 min-2 h; ③ cooling to room temperature under the second sintering pressure to obtain the high-strength dual-scale structure titanium alloy.

2. The preparation method for the high-strength dual-scale titanium alloy according to claim 1, wherein the particle size of said metal powders in step (1) is 20-100 μm.

3. The preparation method for the high-strength dual-scale titanium alloy according to claim 1, wherein said high-energy ball milling in step (2) is conducted at a speed of 2-6 r/s for 1-100 h.

4. The preparation method for the high-strength dual-scale titanium alloy according to claim 1, wherein said mold in step (3) is a graphite mold, and the first sintering pressure is 10-100 MPa.

5. The preparation method for the high-strength dual-scale titanium alloy according to claim 1, wherein said mold in step (3) is a tungsten mold, and the first sintering pressure is 60-500 MPa.

6. The preparation method for the high-strength dual-scale titanium alloy according to claim 1, wherein said cooling to room temperature in step (3) refers to cooling in a furnace or cooling at a rate of 10-250° C./min.

7. The preparation method for the high-strength dual-scale titanium alloy according to claim 1, wherein the high-strength dual-scale titanium alloy comprises Ti 58-70 at. %, Nb 9-16 at. %, Cu 4-9 at. %, Co 4-9 at. %, Al 2-8 at. %, and unavoidable impurities; the high-strength dual-scale titanium alloy comprises two dual-scale phases, including a first phase composed of micro-crystalline equiaxed bcc β-Ti and ultrafine crystalline equiaxed bcc β-Ti, and a second phase composed of micro-crystalline lath fcc $CoTi_2$ and ultrafine crystalline equiaxed fcc $CoTi_2$; or the high-strength dual-scale titanium alloy comprises a dual-scale substrate and ultrafine crystalline fcc $CoTi_2$ twin crystals distributed along the boundary of the dual-scale substrate, and the dual-scale substrate comprises micro-crystalline bcc β-Ti with nano-crystalline acicular martensite α' phase distributed inside.

* * * * *